US005137160A

United States Patent [19]

Santucci

[11] Patent Number: 5,137,160

[45] Date of Patent: Aug. 11, 1992

[54] ADJUSTABLE SELF SUPPORTING LOCKER SHELF AND METHOD FOR INSTALLING SAME

[76] Inventor: Donald G. Santucci, 1154 Avenue Le Provence, Naperville, Ill. 60540

[21] Appl. No.: 593,312

[22] Filed: Oct. 1, 1990

Related U.S. Application Data

[63] Continuation of Ser. No. 360,283, Jun. 2, 1989, abandoned.

[51] Int. Cl.[5] ..... A47F 7/00

[52] U.S. Cl. ..... 211/153; 211/175

[58] Field of Search ..... 211/153, 90, 186, 187, 211/135, 150, 169, 184, 175; 312/136, 293, 314; 108/107, 111, 112

[56] References Cited

U.S. PATENT DOCUMENTS

| | | | |
|---|---|---|---|
| 1,793,036 | 2/1931 | Whitney | 211/150 X |
| 1,876,494 | 9/1932 | Furo | 211/153 |
| 1,879,372 | 9/1932 | McComb | 211/153 |
| 4,118,087 | 10/1978 | Dorf | 211/153 X |
| 4,576,293 | 3/1986 | Hinton | 211/153 X |

*Primary Examiner*—Carl D. Friedman
*Assistant Examiner*—Sarah A. Lechok
*Attorney, Agent, or Firm*—Maksymonko & Slater

[57] ABSTRACT

An add-on shelf for athletic or school lockers having hinged first and second planar shelf members. The edge of the first shelf member is hingedly affixed along the length of the second shelf member, the precise hinge point being adjustable to accommodate differing width lockers. Tabs on the first shelf member engage slots on the second shelf member to form the hinge. A plurality of slots are provided along the second shelf member to facilitate the above-noted width adjustment. Releasable latch means lock the shelf members is fixed planar orientation. Rubber abutment feet are provided along the outside edges of the shelf members to engage the locker walls. The shelf is installed by forming an obtuse angle between the shelf members, placing the shelf assembly into the locker, then, forcing the angle open until the shelf members are in the 180 degree planar locked position.

4 Claims, 2 Drawing Sheets

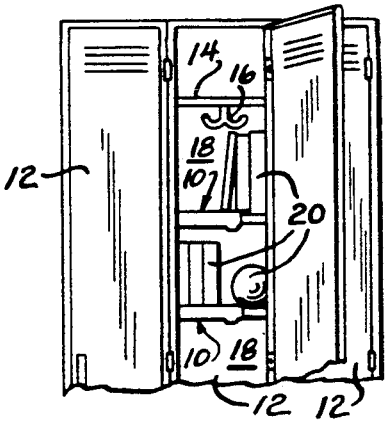
FIG. 1
FIG. 2
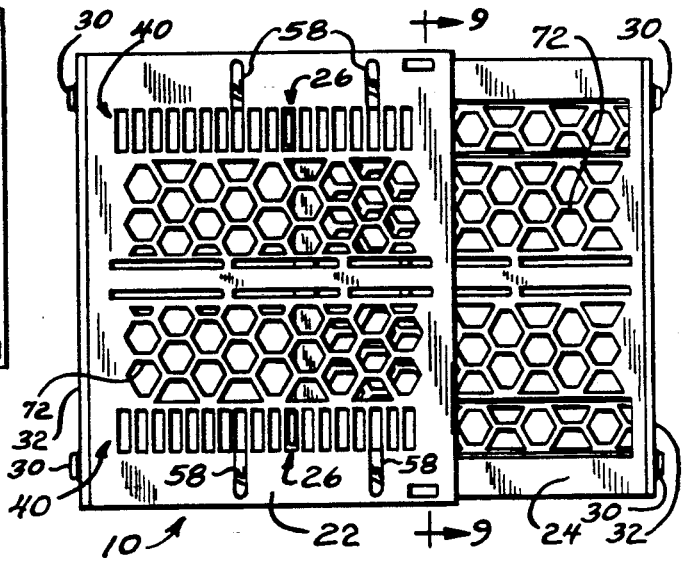
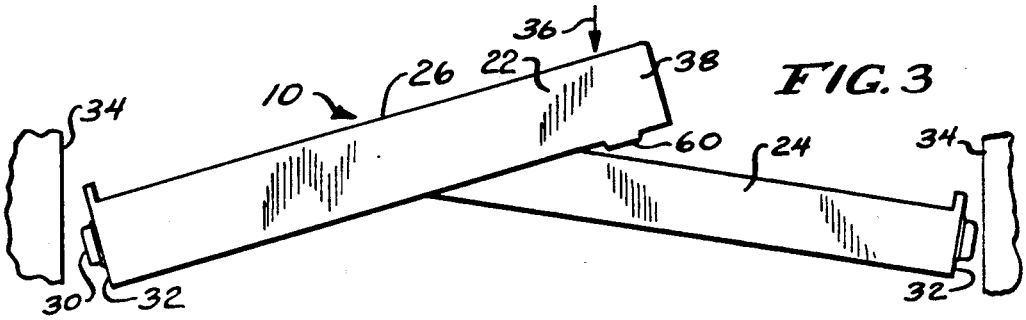
FIG. 3
FIG. 4
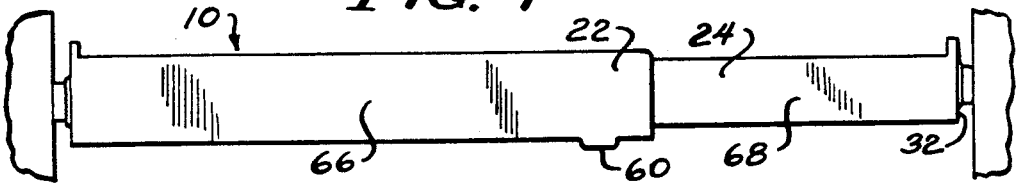
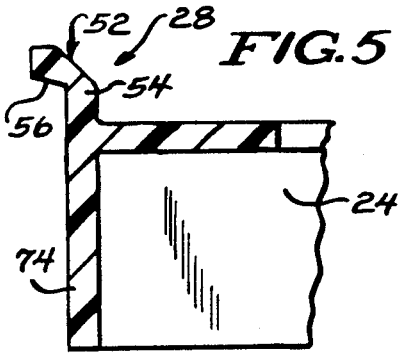
FIG. 5
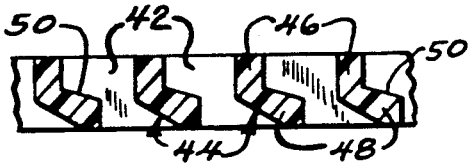
FIG. 6

ADJUSTABLE SELF SUPPORTING LOCKER SHELF AND METHOD FOR INSTALLING SAME

This application is a continuation of application Ser. No. 360,283, filed Jun. 2, 1989 now abandoned.

The present invention relates to shelving, in particular, to a shelf arrangement adapted for after-market installation in athletic or school lockers.

Lockers of the type used in the athletic or school environment are generally characterized by their relatively narrow width, typically between about 10 and 15 inches, but extended vertical form. Such lockers are designed to facilitate the placement of clothing or outer garments in the locker, such garments often being hung from a hook provided in the locker.

Although a single shelf is frequently incorporated in the upper portion of the locker, the main vertical dimension of the locker remains substantially free from shelving thereby facilitating the unobstructed placement of the previously noted clothing therein.

Lockers, however, often serve less for clothing storage but more as a repository for the vast and assorted collection of books, shoes, sporting accessories, and other items required for the ordinary day-to-day scholastic and extra-curricular activities of student users of the locker. Indeed, in the warmer climates and seasons, apparel storage may be of only secondary interest.

Not surprisingly, therefore, the conventional locker presents certain problems with respect to the orderly placement of items therein. The storage capacity of the pre-existing top shelf is quickly exceeded with an ever-increasing mixture of assorted paraphernalia being piled in a heap at the bottom of the locker. Such an arrangement not only precludes the effective use of the limited overall locker space but creates understandable difficulties in accessing buried items.

It is therefore desirable that a means for subdividing the locker space into vertical subspaces be available. It will be appreciated that such means, implemented by the present invention as shelving, should be of a character that it may be added, and subsequently removed, with a minimum of effort; by persons of unknown and varied skill levels, for example students; and without requiring drilling or other defacement of the locker.

The shelf system should be effortlessly adjustable in width to accommodate lockers of differing sizes. Further, the system should facilitate the placement of one or multiple shelves and at arbitrary and/or irregularly spaced intervals therein. And, as noted, installation and removal of the shelves should be virtually instantaneous thereby permitting the user to adapt to changing requirements, for example, the need to add shelves to accommodate additional books or, conversely, the need to remove shelves to return the locker to its garment storage function.

Locker shelving is known to the art. All known shelving, however, falls short of meeting the above-described features or requirements in several important areas. One such system, for example, is not secured to the locker walls and, instead, relies on "legs" to provide the necessary support and spacing. Use of legs creates several obvious problems. First, the legs add cost and, equally importantly, assembly complexity. The legs, as packaged for retail sale, are separate members requiring installation to the shelf prior to insertion of the overall assembly into the locker.

Second, the legs are of limited and predetermined length(s) thereby correspondingly restricting where, and how high, in the locker they may be placed. These prior art shelves must be separated by fixed, rather than arbitrary, distances and, as a practical reality, generally within the bottom portion of the locker.

Shelves positioned in this manner exhibit instability. This instability is caused by two factors. First, the shelves, which are not dimensioned to be securely retained between locker walls, are free to rock laterally back-and-forth. This instability is exacerbated by the legs which, as they are increased in length or are stacked on lower shelves/legs, become wobbly. The load-bearing capacity of these shelves is limited.

Finally, the legs themselves occupy space in each of the four locker corners. This foregone space limits that which can be placed below any leg-supported shelf by creating a protuberance in each corner which renders the placement therein of certain articles such a books, at best, clumsy.

As set forth in more detail hereinafter, the present invention provides a highly efficacious solution to the locker shelf problem—a solution meeting all of the desirable product objectives outlined above. It is, in the first instance, a shelf of the greatest ease of installation—permitting a literal ,snap-fit, by persons of any degree of skill.

Importantly, the shelf system is adjustable to assure its rigid retention between the opposed side walls of lockers of varying width. More specifically, the retention or locking arrangement of the present shelf is predicated on the generation of substantial lateral forces facilitated by a leveraged, adjustable hinge snap mechanism. The shelf, therefore, may be positioned at any arbitrary location within the locker and at any arbitrary spacing from other similar or pre-existing shelves. Any reasonable number of shelves may be added to a locker, and repositioned therein at will.

The substantial compressive lateral forces generated by the leveraged snap mechanism of the present shelf assures very substantial load bearing capability while, significantly, requiring no alteration whatsoever to the locker. The shelf physically and operatively engages the locker side walls through four rubber 'feet', the side wall friction of each serving to resist the downward movement of the shelf within the locker.

The shelf is placed within a locker by ,breaking open, the planar shelf, that is, causing the hinge of the shelf to open thereby defining, rather than a single planar member, a pair of intersecting planar half-shelves pivotally interconnected along the line of their intersection. The ,broken open, shelf is positioned within the locker with the rubber feet in abutting contact with opposed locker side walls. A downward vertical force is applied to the shelf vertex thereby increasing, to 180 degrees, the obtuse angle defined by the two half-shelves. The process whereby the hinged shelf is forced into its single planar 180 degree orientation causes the corresponding outward movement of the opposed shelf ends thereby, in turn, forcing the ends into rigid compressive engagement with the locker side walls. A locking arrangement is provided to retain the shelf in this installed 180 degree orientation.

The shelf may be removed as effortlessly simply by ,unlocking, the hinge and urging the vertex or center of the shelf upwardly thereby releasing the shelf from locking locker engagement. It will be appreciated that the above-described shelf placement or removal may be achieved in literally seconds, and without resort to any significant skill by the user.

Adjustment of the present shelf to accommodate lockers of differing widths is facilitated by use of a variable position vertex whereby the degree of overlap between the mating half-shelves may be adjusted. Decreasing the overlap correspondingly increases the overall installed width of the shelf, and visa versa. More specifically, adjustment is achieved through the use of plural spaced slots on one half-shelf adapted to receive a tabbed member of the other half-shelf for pivotal and locking engagement therebetween. Dimensional markings are provided adjacent the slots to enable the user to preset the vertex point according to a locker width, if known. The entire process of shelf installation, even where vertex adjustment is required, consumes only about 30 seconds.

The present invention is shown and described in more detail in the following figures and detailed description.

FIG. 1 illustrates the locker shelf of the present invention as installed in a typical school or athletic locker environment;

FIG. 2 is a top horizontal view of the present locker shelf;

FIG. 3 is a front elevation view of the locker shelf of the present invention shown within a locker in the unlocked position during the installation process;

Figure 7:
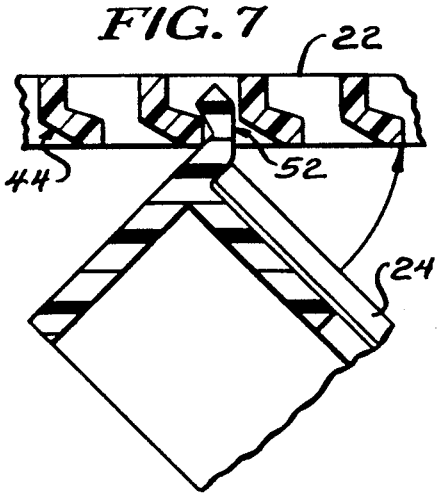
Figure 8:
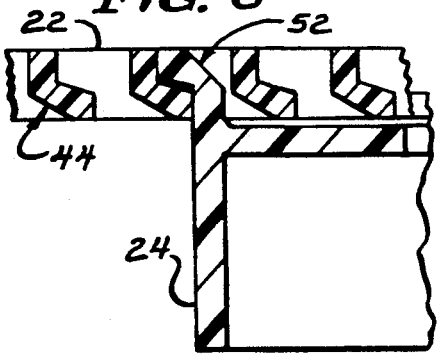
Figure 9:
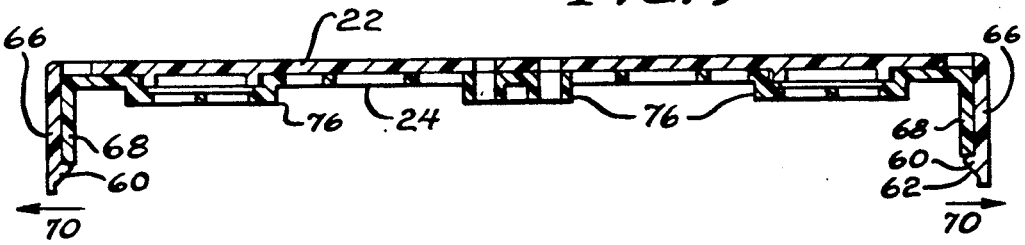
Figure 10:
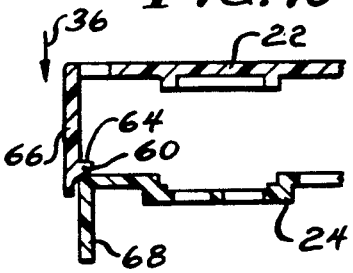
Figure 11:
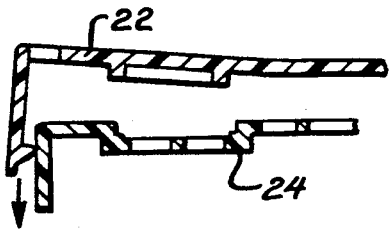

FIG. 4 a front elevation view of the locker shelf of the pres invention shown installed and locked within a locker;

FIG. 5 is a fragmentary sectional view of a tabbed member of the adjustable vertex hinge locking mechanism of the present invention;

FIG. 6 is fragmentary sectional view of the plural spaced slots of the adjustable vertex hinge locking mechanism of the present invention;

FIG. 7 is a fragmentary sectional view illustrating the engagement of the tabbed member of FIG. 5 and a spaced slot of FIG. 6 corresponding generally to the shelf unlocked position of FIG. 3;

FIG. 8 is a fragmentary sectional view illustrating the engagement of the tabbed member of FIG. 5 and a spaced slot of FIG. 6 corresponding generally to the shelf locked position of FIG. 4;

FIG. 9 is a sectional view taken substantially along lines 9—9 of FIG. 2 showing the present shelf in the locked position;

FIG. 10 is a fragmentary sectional view illustrating initial engagement of the locking mechanism during shelf installation; and, FIG. 11 is a fragmentary sectional view illustrating engagement of the locking mechanism immediately prior to the full locking engagement of FIG. 9.

DESCRIPTION OF THE PREFERRED EMBODIMENT

FIG. 1 illustrates a typical locker environment in which the adjustable, self-supporting locker shelf 10 of the present invention is particularly suited for use. As shown, a plurality of individual lockers 12 arranged adjacent one another, each having a single permanent shelf 14 generally in the top region of the locker with a garment hook 16 mounted thereto. Absent the present shelving 10, a single large garment hanging compartment is defined between the permanent shelf 14 and locker bottom (not shown).

Still referring to FIG. 1, a pair of shelves 10 according to the present invention are shown, each depicted with a variety of articles 20 thereon. Such articles, including books, balls, shoes, and similar items, are commonly maintained in student lockers and, absent shelves 10, would likely be found untidely piled in a growing heap on the locker floor.

As best shown in FIGS. 2 and 3, locker shelf 10 is comprised of upper and lower shelf members 22 and 24, respectively, which members mate to define the single planar shelf illustrated in FIGS. 1 and 4. As described in more detail below, mating of the shelf members is achieved through the use of a leveraged, adjustable hinge arrangement (FIGS. 5–8) and a shelf locking mechanism (FIGS. 9–12).

More specifically, a hinge point 26 is defined by the intersection of the tabbed end 28 of the lower shelf member 24 at a point along the length of the upper shelf member 22. The point of intersection is adjustable thereby providing for greater or lesser overlap of the shelf members 22, 24 when in the locked orientation of FIG. 4. Leftward movement of the hinge point 26 (as depicted in the Figures) along the upper shelf member 22 increases the respective shelf member overlap and correspondingly decreases the overall installed width of the shelf 10. Similarly, rightward movement of the hinge point increases the installed shelf width.

The proper hinge point 26 is selected with the shelf members broken open to form an obtuse angle as shown in FIG. 3. More specifically, the correct hinge point is found where the rubber abutment feet 30, which feet are affixed to the respective outer surfaces 32 of the shelf members, are positioned in close proximity to the corresponding left and right locker side walls 34. A downward force, as depicted by arrow 36 of FIG. 3, is applied generally at the inner end 38 of the upper shelf member thereby, in turn, forcing the pivotal rotation of the shelf members about the hinge point 26 until the shelf members assume the locked single planar orientation of FIG. 4.

It will be appreciated that the overall width of the shelf assembly increases as the assembly is urged from its unlocked (FIG. 3) to its locked (FIG. 4) positions. It is this lateral expansion that accounts for the rigid locking engagement of the shelf 10 against the locker side walls 34. It will be further appreciated that the application of a downward force 36, substantially perpendicular to the outward lateral forces created by the corresponding lateral expansion of the shelf causes a leveraging effect whereby a substantially outward shelf retention force is generated through this application of a comparatively lesser downward force The rubber abutment feet 30 serve, firstly, to inhibit the downward sliding movement of the shelf when loaded with articles during use and, secondly, as compressive members to facilitate the precise and final shelf width adjustment upon installation. It will be understood that the walls of a locker may also deform upon shelf installation and, therefore, that it is the elasticity of the rubber feet 30 as well as the locker itself that provides the requisite forces for shelf retention.

FIGS. 5–8 further illustrate the adjustable hinge arrangement of the present invention. In the preferred embodiment, two parallel rows 40 of hinge slots are formed, forward and rearward, along the width of the upper shelf member 22. (See FIG. 2). As seen in FIGS. 6–8, these slots are contoured and defined between generally L-shaped transverse walls 44 having respective vertical upper and sloped lower regions 46 and 48, respectively. More particularly, the sloped lower region 48 further defines a sloped tab receiving surface against which the tabs of the lower shelf member 24, described in more detail below, are slidably received and retained.

With particular reference to FIGS. 5, 7 and 8, a pair of spaced tabs 52 are shown integrally formed along the inner side of the lower shelf member 24. These tabs are received within the upper shelf member slots and cooperate to achieve both hinging action between the respective shelf members 22,24 and the locking thereof. The tabs 52 define generally L-shaped cross-sections, each having a vertical portion 54 and a sloped portion 56, and each adapted to operatively engage a particular slot 42, according to the width of the locker to be fitted, along the parallel hinge slot rows 40. Each tab includes a slot engaging surface along the lower face thereof.

FIGS. 7 and 8 illustrate engagement and operation of the above described adjustable hinge and lock. More specifically, tabs 52 are inserted into appropriate slots 42 of the upper shelf member 22 with specific reference to the width of the locker into which the shelf is to be placed. It will be noted that width markings 58, corresponding to the installed width of the shelf, may be placed adjacent the slot rows. If the width of the locker is known, the user need simply insert the tabs 52 into the appropriately marked slots 42. Alternatively, an iterative process may be employed whereby the tabs are positioned according to an estimate of the locker width. The shelf is thereafter placed into the locker as shown in FIG. 3. If the rubber abutment feet 30 are in close proximity to the locker side walls, normal installation follows. If not, new slots are selected until the proper width dimension is achieved.

The L-shaped contours of tabs and slot walls assure locking engagement both during installation and ultimate shelf use. Referring to FIG. 7, the hinged engagement between the tab and slot generally corresponds to the pre-installation position of FIG. 3. As the downward locking force 36 is applied, as discussed above, the respective upper and lower shelf members rotate into the planar locked orientation of FIGS. 4 and 8.

It will be appreciated that the above-described tab/-slot adjustable hinge assembly functions in the additional and important capacity as a means for locking the respective shelf members against relative lateral (left/-right) movement as well as precluding relative vertical motion between the shelf members at the point 26 of hinge engagement.

The shelf is further locked in its planar orientation as illustrated in FIGS. 9–11. A pair locking tabs 60 are integrally formed along the bottom inner edges of the upper shelf member 22 (see also FIGS. 3 and 4). Each tab 60 includes a sloped lower surface 62 to facilitate, as described hereinafter, the sliding movement of the tabs over the lower shelf member during shelf installation. By contrast, the upper surface 64 of tabs 60 is horizontal and perpendicular to the shelf member side walls to assure locking engagement thereof. In this connection it will be seen that each of the upper and lower shelf members 22 and 24 have respective downwardly extending side walls 66 and 68. The upper shelf side walls 66 override the lower shelf member side walls 68 and it is the engagement between tab 60, extending from the upper side walls 66, and the lower side walls 68 that effect the final shelf member locking engagement as illustrated in FIGS. 4 and 9.

FIG. 10 depicts the positioning of locking tab 60 generally when the respective shelf members 22,24 are oriented as shown in FIG. 3. As a downward locking force 36 is applied to inside end of the upper shelf member 22, the sloped lower tab surface 62 engages the corner of the lower shelf member 24 thereby causing the slight deformation of the upper shelf member 22, illustrated in FIG. 11, as the shelf members are pivoted into planar locking engagement (FIG. 4). Final shelf locking is achieved as the tab clears the lower portion of side wall 68 thereby snapping into locking engagement thereunder.

The present shelf may easily be released for removal or repositioning simply by applying an outward force 70 (FIG. 9) to the upper shelf member side walls 66 thereby deforming the side walls to permit the upward passage of tabs 60. The released shelf assembly thereby returns to foreshortened length (FIG. 3) and may effortlessly be removed or repositioned.

The shelf of the present invention is preferably and most economically fabricated from injection molded plastic. Structural integrity may be assured through a combination of ribs and side walls. In the preferred embodiment, for example, a largely honeycomb contoured shelf surface 72 is supported along its perimeter by side walls 66, 68 and end walls 32 and 74. Ribs 76 provide for additional support and may be integrated with the slot and tab hinge structure, as shown in FIGS. 9–11, to simultaneously enhance the rigidity thereof.

The structure depicted and described herein reveals an inexpensive but highly efficacious shelf arrangement whereby one or more shelves may be installed, virtually instantaneously, in school or athletic lockers and, importantly, without resort to cumbersome leg structures or mechanical locker attachment arrangements. More specifically, the present arrangement employs an adjustable leveraged hinge that permits effortless installation while simultaneously generating large lateral shelf retention forces. It will be appreciated that alternative or modified embodiments of the present invention are contemplated including, for example, differing hinge arrangements, length adjusting structures, locking mechanisms, and overall structural design, both style and structural elements.

What is claimed is:

1. A self-supporting locker shelf comprising first and second generally planar and rectangular shelf members, each shelf member defining a width axis, means for attaching an edge of the first shelf member for pivotal movement on the second shelf member, the attaching means defining a pivotal vertex line between the first and second shelf members, the vertex being oriented perpendicularly to the width axes of the shelf members; the means for attaching the shelf members for pivotal movement includes means for selectively and substantially instantaneously positioning the pivotal vertex line along the width axis of the second shelf member whereby the overall width of the shelf may be correspondingly adjusted; the attaching means includes tab means on the first shelf member and a plurality of slot means in spaced-apart relationship along the width axis of the second shelf member, the tab means being operatively received for pivotal movement in selected slot means whereby the vertex line may be selectively and substantially instantaneously positioned and repositioned along the width axis of the second shelf member.

2. A method for installing a self-supporting shelf in a locker without damaging and defacing locker side walls including the steps of substantially instantaneously attaching a first shelf member for pivotal movement on a second shelf member, the point of attachment defining a pivotal vertex line therebetween, the step of attaching first and second shelf members includes the step of positioning the first and second shelf members at an obtuse angle therebetween and inserting tabs which extend from an edge of the first shelf member into selected first slots in the second shelf member, the step of positioning the shelf members in a locker with the opposed ends thereof adjacent respective locker side walls; the step of urging the relative pivotal movement of the shelf members until the angle defined therebetween reaches substantially 180 degrees, the step of positioning the shelf members in a locker with the opposed ends thereof adjacent respective locker side walls includes the step of substantially instantaneously adjusting the vertex line with respect to at least one of the shelf members thereby assuring rigid compressive engagement between the opposed ends of the locker shelf members and the locker side walls as the shelf members are pivotally moved to the 180 degree orientation.

3. The method for installing a self-supporting shelf of claim 2 including the step of locking the first and second shelf members in said 180 degree orientation whereby the shelf members cannot inadvertently open and release from the compressive side wall engagement.

4. The method for installing a self-supporting shelf of claim 2 wherein the step of adjusting the vertex line includes the step of pivotally rotating the shelf members with respect to one another until an obtuse angle less than 180 degrees is formed therebetween; the step of removing the first shelf member tabs from the second shelf member first slots; the step of inserting the first shelf member tabs into selected second slots in the second shelf member; and the step of urging the relative pivotal movement of the shelf members until the angle defined therebetween again reaches substantially 180 degrees whereby a the overall installed length of the shelf members may be substantially instantaneously adjusted to provide a proper frictional engagement with the locker side walls.

* * * * *